United States Patent [19]

Schowiak

[11] Patent Number: 4,509,684

[45] Date of Patent: Apr. 9, 1985

[54] COLOR CHANGE APPARATUS

[75] Inventor: Duane C. Schowiak, Novi, Mich.

[73] Assignee: Ford Motor Company, Dearborn, Mich.

[21] Appl. No.: 444,401

[22] PCT Filed: Sep. 30, 1982

[86] PCT No.: PCT/US82/01375

§ 371 Date: Sep. 30, 1982

§ 102(e) Date: Sep. 30, 1982

[87] PCT Pub. No.: WO84/01312

PCT Pub. Date: Apr. 12, 1984

[51] Int. Cl.[3] ..... B05B 15/02

[52] U.S. Cl. ..... 239/112; 239/124; 239/305

[58] Field of Search ..... 239/112, 113, 124, 127, 239/142, 305, 416.1, 416.2, 417.5, 525, 526, 527

[56] References Cited

U.S. PATENT DOCUMENTS

| | | | |
|---|---|---|---|
| 3,023,968 | 3/1962 | Mitchell | 239/142 |
| 3,145,930 | 8/1964 | Herklotz et al. . | |
| 3,155,531 | 11/1964 | Juvinall . | |
| 3,219,273 | 11/1965 | Killen . | |
| 3,330,290 | 7/1967 | Porter . | |
| 3,403,695 | 10/1968 | Hopkins | 239/112 |
| 3,450,092 | 6/1969 | Kock | 239/112 |
| 3,458,133 | 7/1969 | Wiggins . | |
| 3,477,870 | 11/1969 | Boretti et al. . | |
| 3,672,570 | 6/1972 | Scarbrough et al. | 239/112 |
| 3,674,205 | 7/1972 | Kock | 239/112 |
| 3,716,191 | 2/1973 | Knight | 239/112 |
| 3,857,513 | 12/1974 | Wiggins | 239/112 |
| 3,924,806 | 12/1975 | Schowiak . | |
| 4,005,825 | 2/1977 | Schowiak | 239/526 |
| 4,085,892 | 4/1978 | Dalton | 239/127 |

*Primary Examiner*—Jeffrey V. Nase
*Assistant Examiner*—Michael J. Forman
*Attorney, Agent, or Firm*—Roger L. May; Keith L. Zerschling

[57] ABSTRACT

An apparatus for effecting rapid color change of the color component of a multiple component sprayable fluid to be applied using a manual spraygun. The apparatus includes primary and secondary color changer means, each having a manifold with a through passage. Color component to be applied to a substrate enters the primary color changer manifold and passes out of that manifold through a metering pump and flow sensor to the secondary manifold from which it passes through a color outlet line and ultimately to a spraygun. Apparatus is adapted to effect rapid flushing and color change by sequencing color inlet and outlet valves and flush and dump valves so as to effect rapid flush of the lines and connection of the subsequently filled color changers to color outlet lines.

6 Claims, 2 Drawing Figures

COLOR CHANGE APPARATUS

TECHNICAL FIELD

The present invention is directed to the field of apparatus for applying multiple component sprayable fluids to a substrate using a manual spraygun. More particularly, the invention is directed to that portion of the above-noted field which is concerned with applying sprayable coating compositions which must be mixed in metered amounts just prior to application so as to avoid coreaction between components such as a color component and a crosslinking component. More particularly still, the present invention is concerned with the provision of apparatus for effecting rapid color change of the color component of a multiple component sprayable coating composition being applied to the substrate through the spraygun, which apparatus is adapted for rapidly flushing the system prior to changing to the next desired color.

BACKGROUND ART

In recent years the automobile industry has engaged in intensive research to develop coatings which require reduced energy consumption and which may be applied at reduced volatile organic compound (VOC) emissions levels. Recently developed multiple component sprayable coatings, which crosslink or cure upon combination of the components as they are applied, appear to offer a potential for not only reducing oven temperatures, and hence energy consumption, without adverse effect to the quality of the finish or the time required for completing crosslinking of the coating, but also potential for reducing VOC emissions. These multiple component coating materials which crosslink on the substrate after application normally include a crosslinking "accelerator" which is capable of increasing the rate of crosslinking at any given temperature. By varying the quantity of accelerator present in a coating, the crosslinking rate may be varied. The presence of any accelerator induces a tendency to crosslink at low, ambient, temperature and necessitates the maintaining of the material in component form until immediately prior to application as a coating.

Various multiple component coatings are available and will be apparent to those skilled in the art. One general class of two component paint system is based on polyurethane chemistry. Compositions of this type require one component containing a hydroxy functional resin (usually the color component) and another component containing an isocyanate crosslinker. These two components must be combined just prior to application to the substrate because the components would react prematurely if combined earlier. As is the case with all multiple component paint systems where a crosslinking reaction occurs after combination of components, the materials must be combined in precise amounts and, therefore, must be pass through or into the spraygun in metered amounts where they are combined just prior to application to the substrate. In order to combine the components in the proper ratio, it is therefore necessary to include metering means such as metering pumps and flow sensors as part of the apparatus used to apply the coatings.

Since multiple component materials must be combined in precise ratios as discussed above, thus necessitating more complex metering equipment, color change and flushing necessary to do so are greatly complicated.

This is a particularly significant problem when coating operations require frequent, rapid color changes, such as in the automobile industry where it is very common to change colors between units on the line. In order to change a color, substantial quantities of solvent must be expended in order to remove all vestiges of coating material, particularly crosslinked material, from the spray apparatus and to remove all vestiges of the color component from those portions of the apparatus through which the color component passes. In order to avoid the necessity of having separate feed apparatus for each selected color including separate metering means for each, it is necessary to provide a means of rapidly flushing a single apparatus which can be used for all colors. It is also highly desirable to accomplish this flushing of the spray apparatus including the feed apparatus for the color component with a minimum amount of solvent and with as little waste of coating materials as possible. It is therefore a specific object of the present invention to provide an improved apparatus for effecting rapid color change of the color component of a multiple component sprayable fluid to be applied using a manual spraygun.

U.S. Pat. Nos. 3,145,930 to Herklotz et al. and 3,219,273 to Killen each disclose painting systems adapted to be flushed prior to changing colors. While neither of these painting systems employs multi-component paints, they do include pumps which must be flushed prior to color change. U.S. Pat. Nos.: 3,155,531 to Juvinall; 3,403,695 to Hopkins; 3,450,092 to Kock; 3,458,133 to Wiggins; 3,477,870 to Boretti et al.; 3,672,570 to Scarborough et al.; 3,674,205 to Kock; and 3,857,513 to Wiggins all teach painting or coating systems providing for color change.

U.S. patent application Ser. No. 260,221 filed May 1, 1981, now abandoned, in the name of Courtney et al. and assigned to Ford Motor Company, assignee of this application, teaches a flushable metering pump for use in a painting apparatus requiring rapid color change. This flushable metering pump, which is taught as being particularly suitable for use in systems for application of mutli-component paint compositions, is particularly well suited for use in the apparatus of the present invention. U.S. Pat. Nos. 3,924,806 and 4,005,825 to Schowiak and also assigned to Ford Motor Company, teach a spraygun including a mixing manifold, which is particularly suitable for use in spraying multi-component coating compositions wherein the components must be admixed just prior to application. The spraygun taught in these patents is particularly suitable for use in conjunction with the apparatus of the present invention.

DISCLOSURE OF THE INVENTION

The present invention provides an apparatus for effecting rapid color change of the color component of a multiple component sprayable fluid to be applied using a manual spraygun. The apparatus comprises:

(A) A primary color changer means which comprises (i) a manifold having a passage therethrough, (ii) a plurality of color inlet means, one for each of a selected number of colors of the color component, which are in communication with the through passage of the manifold and which are adapted to be selectively opened when the selected color component is in use for spraying and closed when it is not in use, (iii) a solvent/air inlet means in communication with the through passage of the manifold and adapted to be opened during flushing of the apparatus and closed during spraying, and (iv) outlet means in communication with the through passage of the manifold and adapted to allow fluid from the through passage to flow out of the primary color changer and into an outlet line;

(B) A solvent/air inlet line attached to the solvent/air inlet means and adapted to carry solvent and/or air for flushing the apparatus prior to color change;

(C) Color component inlet lines, one for each of the selected number of colors, attached to each of the corresponding color inlet means of the primary color changer means and filled with the selected color component;

(D) An outlet line adapted to carry fluid from the primary color changer means to a secondary color changer means, said line being attached to the outlet means of the primary color changer means and the inlet means of the secondary color changer means;

(E) Flushable metering means disposed in the outlet line between the primary and secondary color changer means;

(F) Secondary color changer means comprising: (i) a manifold having a passage therethrough, (ii) inlet means to which said outlet line for conveying fluid from said primary color changer means to said secondary color changer means is attached, said inlet means being in communication with the through passage, (iii) a plurality of color outlet means, one for each of the selected number of colors of the color component, the outlet means being in communication with the through passage and being adapted to be closed during flushing of the apparatus and selectively opened during spraying when the selected color component is in use, and (iv) outlet flush means in communication with the through passage of the manifold and adapted to be opened during flushing of the apparatus and closed during spraying; and (G) Color component outlet lines attached to the plurality of outlet means of the secondary color changer, each being filled with a selected color of the color component and each being adapted to be connected to a spraygun.

In a particularly preferred embodiment of the invention, the selected color components are circulated continuously when the color is not in use for spraying. This is accomplished by forming a continuous supply line or circuit in which the color component is recirculated. The continuous line is formed by connecting by a quick disconnect fitting one end of the line to the other. The inlet line to the primary color changer means and the outlet line from the secondary color changer means for each selected color merge into this continuous line in which the color component is recirculated. A valve means is placed in the continuous line between the point where the inlet line to the primary color changer means leaves the continuous line and the point where the outlet line from the secondary color changer means enters the line. Thus, when it is desired to employ the particular color component, the continuous line is disconnected and the quick disconnect fitting connected to the spraygun for use of the color component. Simultaneously, the aforementioned valve means is closed such that paint coming to the spraygun travels through the secondary color changer means, out through the color outlet means and through the color outlet line to that portion of the continuous line which is attached to the spraygun.

The apparatus of the invention will be more fully understood by reference to the following detailed description of the several preferred embodiments of the invention when read in conjunction with the drawings.

DETAILED DESCRIPTION OF THE INVENTION

The invention will be described more specifically in conjunction with the drawings wherein like numbers designate like structure in the two figures.

Figure 1:
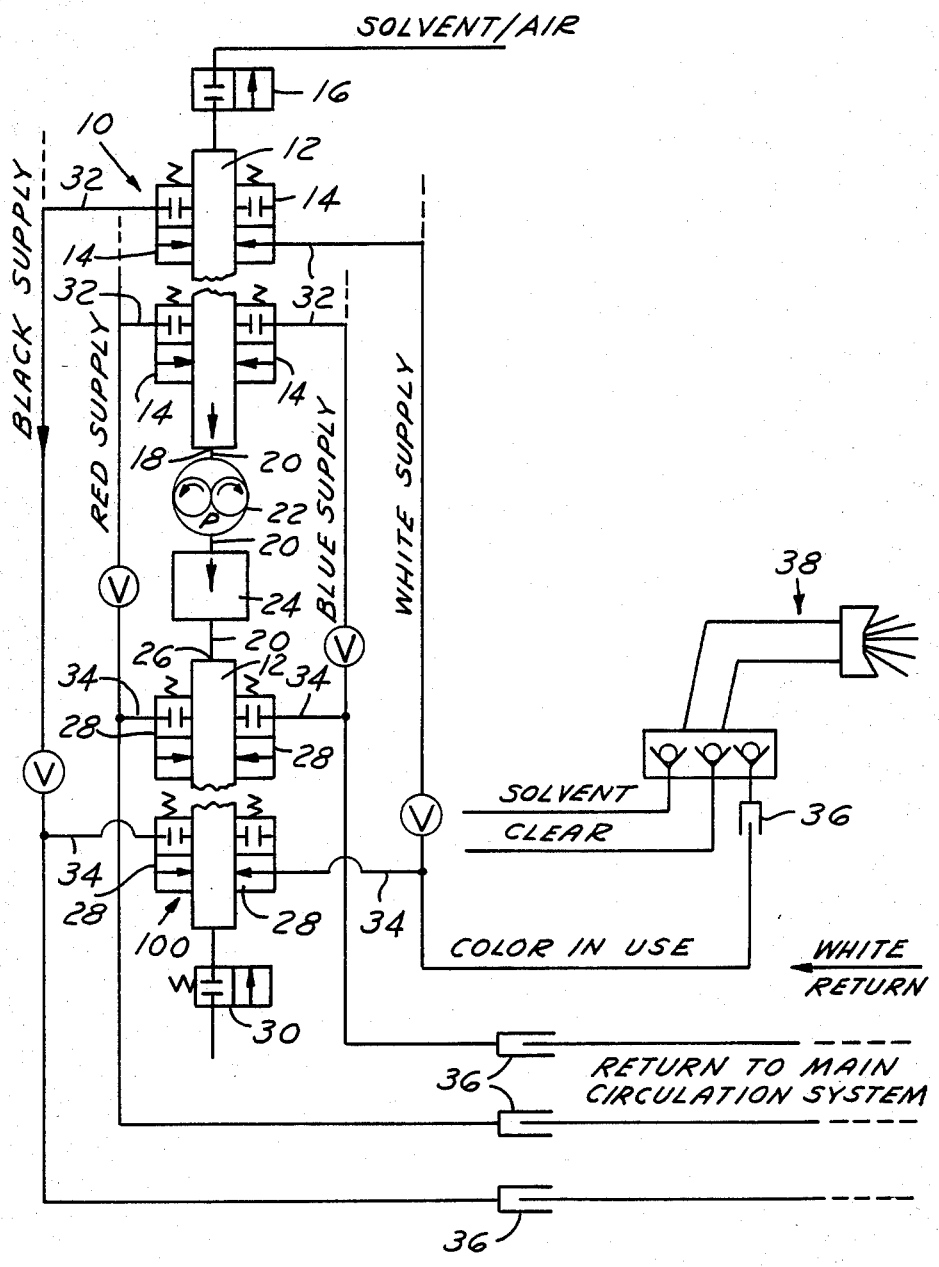
FIG. 1 is a schematic diagram of a preferred embodiment of the apparatus of the invention wherein the various color components are recirculating when not being sprayed.
Figure 2:
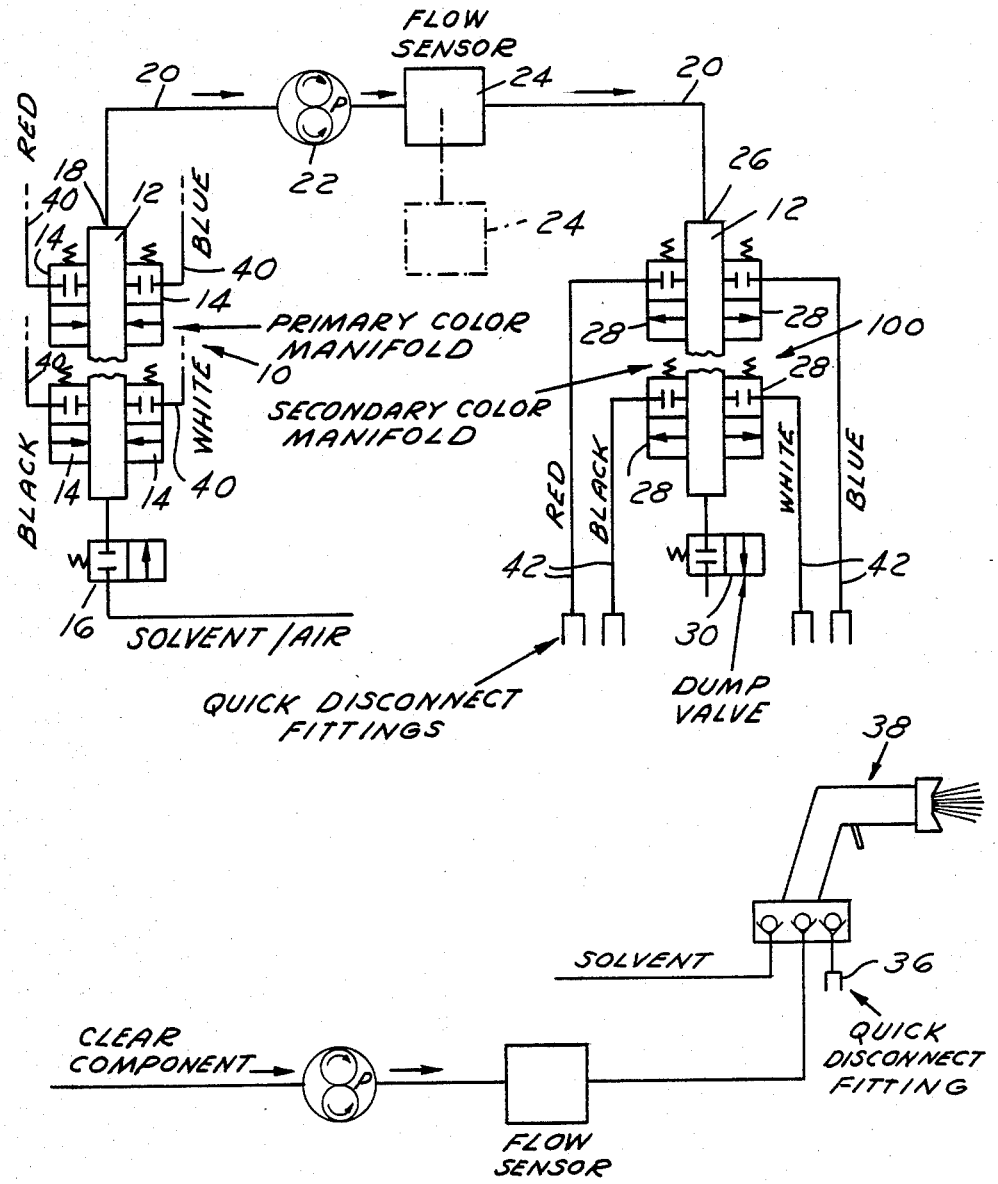
FIG. 2 shows a schematic diagram of an apparatus of the invention wherein the outlet lines from the secondary color changer are adapted to be connected directly to the manual spraygun and the color components are not recirculating when not in use.

FIG. 1 shows a preferred embodiment of the invention wherein color components recirculate when not being sprayed, while FIG. 2 shows another embodiment wherein no recirculation takes place. Each of the embodiments shown comprises primary color changer or manifold 10 and secondary color changer or manifold 100. Each of the color changers or manifolds may be a conventional color changer such as a Binks Diaphragm-Valved Automatic Paint Color Changer No. 97-2000 sold by Binks Manufacturing Company of Chicago, Ill. These changes include a manifold with a through passage 12 as well as several various inlet and outlet means adapted to be attached to various lines.

Referring to color changer 10 there are shown a plurality of color inlet means or valves 14, one for each of four selected colors shown in the drawing. These inlet means or valves are in communication with through passage 12 and are adapted to be opened when the selected color component is in use and closed when it is not in use. In FIG. 1, the color inlet means or valves for the black, red and blue lines are shown in a closed position while the color inlet means for the white color component is shown in an open position. In FIG. 2, all of the color inlet means are shown in a closed position.

Color changer 10 is also shown as having a solvent/air inlet means or valve 16 which is in communication with through passage 12 of the manifold and which is adapted to be opened during flushing of the apparatus and closed during spraying. This valve is shown in a closed position in both FIGS. 1 and 2.

Also included in primary color changer means 10 is an outlet means 18, which is merely shown as an opening in communication with the through passage, which outlet means is adapted to allow the fluid from the through passage 12 to flow out of the primary color changer 10 and into an outlet line 20.

As shown in the drawings the various inlet and outlet means of the color changer 10 are connected to (a) the solvent/air line in the case of the solvent/air inlet means 16, (b) the various color lines in the case of the color inlet means 14 and (c) the outlet line 20 in the case of the outlet means 18.

Outlet line 20 is shown as passing through or having disposed therein flushable metering means which in both FIGS. 1 and 2 includes a flushable metering pump 22 and a flow sensor 24. In FIG. 2, as shown in phantom lines, the flow sensor may be moved to a sideline off the outlet line 20 if desired. In fact, the flow sensor need not be used at all in embodiments of the invention which are not intended for use with computerized controls discussed below.

Flushable metering pump 22 may be any type of commercially available metering pump which may be flushed so as to remove vestiges of color therefrom between cycles of painting with different colors. This pump should be capable of metering the amount of material passing through the outlet line 20 precisely and should also be capable of being flushed rapidly. One particularly suitable type of metering device which may be employed is the positive displacement, gear-type metering pump described and claimed in application Ser. No. 260,221 filed May 1, 1981, referred to above and hereby incorporated by reference. The flushable pump of that invention is a modified positive displacement, gear-type metering pump which allows high pressure gas and/or solvent used to flush the apparatus to at least partially bypass the metering pump. That modified positive displacement, gear-type metering pump incorporates: channel means for conveying fluid into the inlet chamber and directing the fluid against the gear faces exposed to the inlet chamber; channel means for conveying fluid from the inlet chamber to a valve means; channel means for conveying fluid from the valve means to the outlet chamber; and valve means adapted to be opened in open or closed modes. The valve means is adapted to be in a closed mode when the metering pump assembly is in a metering mode such that fluid may pass from the inlet chamber to the outlet chamber only when being carried between the gear faces and the wall of the pump housing as is conventionally the case with such pumps. The valve means is adapted to be in an open mode when the metering pump assembly is in a flushing mode such that the fluid may pass from the inlet chamber to the outlet chamber not only between the gear faces and the wall of the pump housing, but also through the channel means for conveying fluid from the inlet chamber to the valve means, and the channel means for conveying fluid from the valve means to the outlet chamber. By incorporating the valve means into the pump assembly so that the flushing fluid may be flushed through the pump assembly more rapidly than can be accomplished by increasing the RPM of the pump, and by directing fluid through the channel means on the gear faces which are exposed to both the inlet and the outlet chambers of the pump, it is possible to flush the metering pump substantially faster than would otherwise be possible.

After passing through flushable metering pump 22, the metered color component passes through optional flow meter 24. This flow meter may be a commercially available flow meter such as the Micro Motion flow sensor Model C-24 manufactured by Micro Motion, Inc. of Boulder, Colo. The apparatus as shown in the drawings is adapted to be used as part of a system for ratio control of fluid flow systems which is preferably employed to monitor the amount of color component and clear component being fed to a spraygun for a two component paint system such as a urethane paint system. In accordance with this preferred flow system, the "color component" volumetric flow rate is set manually by adjusting a conventional pressure regulator, not shown, until the required flow is obtained. The flow of the "clear" or crosslinking stream is controlled by a computer which adjusts the pump speed set point of the metering unit metering the clear component. The flow of each stream is monitored by a positive displacement flow meter or flow sensor such as the Micro Motion unit discussed above. This sensor generates voltage proportional to the flow. The computer reads the flows of the "color" and "clear" and adjusts the pump speed to increase or decrease the "clear" flow and achieve the necessary specified ratio for crosslinking of the system. Thus, the flow meter senses the flow rate of the color portion and transmits this information to a central computer. The computer then calculates the flow required of the "clear" component in order to maintain the necessary ratio and transmits a signal to the "clear" flow control device or pump, thus adjusting the flow of the "clear". Finally the adjusted flow rate of the "clear" is sensed by the flow sensor and this information is also transmitted to the computer which verifies the proper flow of the "clear" and "color" components to achieve the necessary ratio. This closed loop system of flow measurement, analysis, adjustment and verification is, of course, very rapid and the overall system response is less than one-half second. In fact, the normal time interval between the change in flow rate or the color component and the adjustment of the "clear" is only about 200 milliseconds. Verification is included in the system only as a precaution and to indicate that proper flow adjustment has occured. In the event of a major malfunction, the spray system would be automatically stopped rather than be allowed to continue on an "off-ratio" condition.

In those cases where the apparatus of the invention is intended for use in a system which does not include an automatic fluid flow control as above, flow sensor 24 may be eliminated. In such a case the flushable metering pump is merely set at the speed necessary to pump color component at a selected rate and the rate on the pump of the clear component line is set at a speed necessary to give the proper ratio of the two components.

After passing through flow sensor 24 the color component continues through outlet line 20 and enters secondary color changer or manifold 100 through inlet means 26 which is merely an opening into the through passage 12 of the manifold. Secondary color changer or manifold 100 has a plurality of color outlet means 28, one for each of the selected number of colors of the color component. Color outlet means or valves 28 are adapted to be closed during flushing of the apparatus and selectively opened during spraying of the selected color. In FIG. 1, the color outlet means or valves 28 for blue, red and black are shown in an closed position while the color outlet means or valve for white is shown an opened position. In FIG. 2 all of the color outlet means or valves 28 are shown in a closed position. Secondary color changer or manifold 100 also includes outlet flush means or dump valve 30 in communication with the through passage of manifold 12 and adapted to be opened during flushing of the apparatus and closed during spraying. The outlet flush means is shown in a closed position in both FIGS. 1 and 2.

In FIG. 1, each of the color inlet lines 32 and the color outlet lines 34 are shown merging into the continuous color supply line for the corresponding color . The various supply lines which are labelled in FIG. 1 are continuous in that they form a continuous loop through which the paint may be maintained in circulation while that particular color is not in use. The loop is completed by quick disconnect valves 36 which may be disconnected after appropriate valve V is closed and then reconnected to spraygun 38 when that selected color is to be employed. FIG. 1 shows a system set up to spray the white color component. It should be noted that the white supply line is disconnected and the quick disconnect fitting has been connected to spraygun 38. Valve V in the white supply line would be in a closed position. Color inlet means valve 14 to which color inlet line 32 from the white supply line is connected is in an open position, thus allowing the white color component to enter the primary color changer manifold. The white color component would fill this manifold and pass under pressure through outlet means 18 into outlet line 20 and then sequentially through metering pump 22 where a desired amount of a color component is metered and then through flow sensor 24 which, as discussed above, would sense the flow rate and send a signal to the computer in order to adjust the flow rate of the clear component to give the proper ratio of clear component to color component. After leaving the flow sensor the material continues to pass through outlet line 20 and into secondary color changer means or manifold 100 through inlet 26. The white component fills the secondary color changer and passes out through color outlet valve 28 through color outlet line 34 to the white supply line which is connected to the spraygun 38 by quick disconnect fitting 36.

In the embodiment of FIG. 2, the color inlet lines 40 and the color outlet lines 42 do not merge with any continuous supply lines for the various color components. Rather, in this embodiment color inlet lines 40 connect to a source of the particular color component which may be maintained in a container providing for circulation of the paint therein. Color outlet lines 42 remain filled with paint which is not circulating. As a given color component is to be employed the color outlet line for that particular color is merely connected by the quick disconnect fitting thereon to the fitting of spraygun 38. In those cases where frequent color changes are made between the various colors in the color outlet lines and the color inlet lines, the system shown in FIG. 2 presents no significant problems in connection with settling of pigment or other paint components in the lines. However, if a particular color component is not employed over a long period of time this embodiment may be less desirable in that the pigment or other components may settle out in the line.

Manual spraygun shown schematically as 38 in FIGS. 1 and 2 includes, as mentioned above, a fitting for connecting the color outlet line in the case of FIG. 2 or the disconnected segment of the color supply line as 35 is the case in FIG. 1. In addition, as shown, the spraygun provides for attachment of the "clear" feed line and a solvent line. The solvent line is provided in order to provide for a source of solvent to flush the gun between colors. The "clear" line is, of course, the feed line through which the clear component is fed after passing through its own metering pump and optional flow sensor. As discussed above, the preferred manner for using the apparatus of the invention is in conjunction with a computerized system which adjusts the feed speed of the metering pump for the clear component to the metering speed of the meter pump of the color component. The flow sensor is present to check and feed back the speed of the clear component to assure that the proper feed ratio has been maintained.

The manual spraygun which is employed in conjunction with the apparatus of the present invention may be any conventional spraygun such as an air atomizing spraygun. Representative of such types of guns are the Devilbiss JGA air atomizing spraygun or a Binks Manufacturing Company air atomizing spraygun Model 62. A particularly preferred type of air atomizing spraygun is that type disclosed in aforementioned patents 3,924,806 and 4,005,825. This air atomizing spraygun is modified by the inclusion of a fluid mixing manifold which is adapted for attachment to the butt end of the handgrip portion of the aforementioned conventional air atomizing sprayguns. The manifold is attachable to the air atomizing spraygun through the conventional air hose connection and includes an air hose connection passage. The manifold further includes a fluid passage separate from the air hose connection passage having a plurality of fluid inlet ports and a single fluid exhaust port. The fluid exhaust port is connected by means of a conventional static mixer such as a Kenics mixer to the sprayable fluid inlet passage of the air atomizing spraygun. The multiple fluid inlet ports for the manifold passage are spaced apart and are adapted to receive, variously, a solvent or flushing agent, the crosslinking component of the multiple component sprayable fluid coating and the color-providing component of the multiple component coating. Each of the inlet ports of the manifold passage is provided with a check valve means adapted to permit flow through the valve means into the manifold passage and to block fluid flow from the manifold passage through the check valve means.

As indicated above, the apparatus of the present invention is designed to effect rapid color change while minimizing the use of solvent and the waste of paint. As also discussed above, the system of FIG. 1 is set up to supply white color component to spraygun 38. In order to change from the white color component to, for example, the red color component a simple sequence of events must occur. First, after the last vehicle or other substrate to be painted is coated with the white paint, both the color inlet means or valve 14 for the white color component and the color outlet means or valve 28 for the white color component would be closed. Next the solvent/air inlet means or valve 16 is opened allowing solvent and air under pressure to enter primary color changer means 10. This solvent/air flush material passes through passage 12 rinsing the white color component from the interior thereof. Next the solvent/air flush material passes through flushable metering pump 22 and flushable flow meter 24 and continues to pass through line 20 into secondary color changer means 100. The material continues to flush out the white color from the manifold through passage of secondary color changer 100 and finally passes out the solvent/air outlet or dump valve 30 which is opened. Simultaneously the quick disconnect for the white line may be removed from the spraygun and reconnected to the remaining portion of the continuous white supply line. The valve V on the white supply line is then opened to allow the white color component to circulate.

Simultaneously with the above flushing of the color changer apparatus, the spraygun 38 may be flushed with solvent to remove vestiges of the color component.

In order to change to the red color component, the valve V on the red supply line is closed and the red line disconnected at the quick disconnect 36 which is then reconnected to spraygun 38. Color inlet means 14 is opened to allow paint from the color inlet line 32 connected to the red supply line to flow into and fill primary color changer means 10. Solvent/air inlet means 16 is in a closed position and the paint thus flows out primary color changer outlet means 18 through line 20, passing through metering pump 22 and flow sensor 24 and then into secondary color changer means 100. The secondary color changer means 100 is filled with the red color component and dump valve 30 is opened momentarily to dump out any color component which may be combined with residual solvent. After the dump valve 30 is closed, color outlet means valve 28 associated with color outlet line 34 running into the red supply line is opened thus allowing the red color component to flow therethrough and into that portion of the red color supply line which is now connected to spraygun 38.

Color change of the system depicted in FIG. 2 would occur in a similar manner. If that system were shown set up to spray a particular color and it was desired to switch to still another color, the color outlet line attached to the spraygun would be removed and the valves 14 and 28 in the primary and secondary color changer means respectively would be closed for the particular color which had been in use. Next the solvent/air inlet means 16 would be opened allowing the solvent to flush through the primary color changer means 10, through outlet line 20, metering pump 22, flow sensor 24 and into secondary color changer means 100 before exiting with the flushed out color component through dump valve 30. Next the color valve 14 for the selected color would be opened allowing that color component to fill the primary color changer means 10 as well as line 20, pump 22, flow sensor 24 and finally secondary color changer means 100. A small amount of the paint would be dumped out dump valve 30 to wash out any residual solvent still in the system. After the dump valve was closed, the appropriate color outlet line 42 would then be connected to the spraygun 38 which would have been by that time also flushed by solvent.

As will be apparent to those skilled in the art to which the present invention applies, the various inlet and outlet means or valves may be controlled and sequenced manually or, more conventionally, automatically. Preferably, for example, the various means are air operated valves which are controlled from an electric solenoid bank which is, in turn, controlled by a conventional programmable logic controller or computer.

As can be appreciated from the above description of the flushing techniques employed with this apparatus, the apparatus does, in fact, provide an efficient manner for changing colors with a minimal usage of solvent and minimal waste of paint during color change. It will also be appreciated that the apparatus of the present invention results in considerable cost savings inasmuch as it requires only one set of lines, pumps and flow sensors for all color components employed as opposed to systems that require multiple lines, pumps and sensors.

It will be appreciated that the apparatus embodiment shown in the drawings and the discussion thereof are presented merely by way of example and are not intended to be limited. It will be apparent to those skilled in the art that various other embodiments of the apparatus may be constructed within the scope of the invention as defined by the appended claims.

What is claimed is:

1. An apparatus for effecting rapid color change of the color component of a multiple component sprayable fluid to be applied using a manual spraygun, characterized in that said apparatus comprises:

(A) Primary color changer means comprising
  (i) a primary manifold having a primary through passage,
  (ii) a plurality of primary color inlet means, one for each of a selected number of colors of said color component, said primary color inlet means being in communication with said primary through passage and being adapted to be selectively opened when the selected color component is in use and closed when it is not in use,
  (iii) solvent/air inlet means in communication with said primary through passage and adapted to be opened during flushing of said apparatus and closed during spraying, and
  (iv) primary outlet means in communication with said primary through passage and adapted to allow fluid from said primary through passage to flow out of said primary color changer means and into a primary outlet line;

(B) A solvent/air inlet line attached to said solvent/air inlet means and adapted to carry solvent and/or air for flushing said apparatus prior to color change;

(C) Primary color component inlet lines, one for each of said selected colors, attached to each of said corresponding primary color inlet means of said primary color changer means and filled with the selected color component;

(D) A primary outlet line adapted to carry fluid from said primary color changer means to a secondary color changer means, said primary outlet line being attached to said primary outlet means of said primary color changer means and a second inlet means of said secondary color changer means;

(E) Flushable metering means disposed in said primary outlet line between said primary color changer means and said secondary color changer means;

(F) Said secondary color changer means comprising
  (i) a secondary manifold having a secondary through passage,
  (ii) secondary inlet means to which said primary outlet line for conveying fluid from said primary color changer means to said secondary color changer means is attached, said secondary inlet means being in communication with said secondary through passage,
  (iii) a plurality of secondary color outlet means, one for each of said selected number of colors of said color component, said secondary outlet means being in communication with said secondary through passage and being adapted to be closed during flushing of said apparatus and selectively opened when the selected color component is in use,
  (iv) outlet flush means in communication with said secondary through passage and being adapted to be opened during flushing of the apparatus and closed during spraying; and (G) Secondary color component outlet lines, one for each of said selected colors, attached to each of said secondary color outlet means of said secondary color changer, each being filled with the selected color component and each being adapted to be connected to a spraygun.

2. An apparatus in accordance with claim 1, wherein said flushable metering means comprises a flushable, positive displacement, gear-type metering pump assembly.

3. An apparatus in accordance with claim 2, wherein said flushable metering means also includes a flushable flow sensor through which said primary outlet line passes after said flushable metering pump.

4. An apparatus in accordance with claim 1, wherein each of said primary color inlet lines to said primary color changer means and each of the corresponding secondary color outlet lines from said secondary color changer means merge with a continuous supply line in which the selected color component carried by such primary inlet and secondary outlet lines is continuously recirculating when the color component contained therein is not in use, said continuous line having valve means therein between the point where said primary color inlet line to said primary color changer means leaves said continuous line and the point where said secondary color outlet line to said secondary color changer means enters said continuous line, and said continuous line containing connector means adapted to be (i) disconnected when said valve means is closed and said secondary outlet means for said secondary outlet line is opened and (ii) connected to a spraygun for use of said color component.

5. An apparatus in accordance with claim 1 further comprising a flushable manual spraygun to which is connected a line carrying any of the selected color components from the various secondary outlet lines of said secondary color changer means.

6. An apparatus in accordance with claim 5, wherein said line is any one of the various secondary outlet lines of said secondary color changer means.

* * * * *